United States Patent [19]

Horibata et al.

[11] Patent Number: 4,457,084

[45] Date of Patent: Jul. 3, 1984

[54] HOPPING AND DANCING SHOES

[76] Inventors: Hiroshi Horibata, Mitaka House No. 25-20, 5-chome, Kamirenjaku, Mitaka-shi, Tokyo 181, Japan; John W. Sondreal, 4109 Pleasant Ave., Norfolk, Va. 23518; Henry Chu, 7-3 Jen Ai Rd. Sec. 2, Taipei, Taiwan

[21] Appl. No.: 252,162

[22] Filed: Apr. 8, 1981

[51] Int. Cl.[3] ..... A43B 3/10; A43B 13/18

[52] U.S. Cl. ..... 36/7.8; 36/28

[58] Field of Search ..... 36/7.8, 28, 29

[56] References Cited

U.S. PATENT DOCUMENTS 2,710,460 6/1955 Stasinos ..... 36/7.8

2,715,785 8/1955 Pace ..... 36/7.8

4,196,903 4/1980 Illustrato ..... 36/7.8

*Primary Examiner*—Patrick D. Lawson

[57] ABSTRACT

A hopping and dancing shoe comprises a sole member, a base member parallel thereto, and a spring therebetween. Two means are provided by the spring to resist yawing of the sole member relative to the base member: (1) the spring has an axial extension of each end which is connected to the sole member and base member, respectively; and (2) the extreme outer coils of the spring are in contact with the sole member and base member, respectively, to provide frictional contact there between.

4 Claims, 9 Drawing Figures

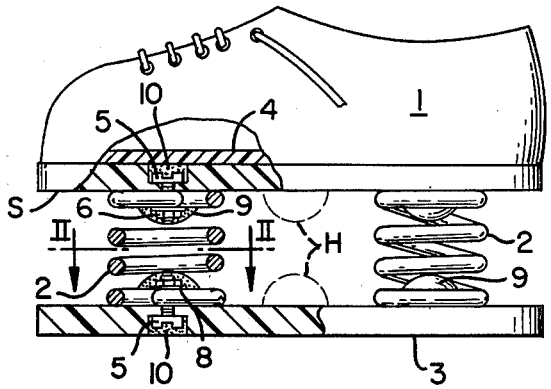
FIG. 1
FIG. 2
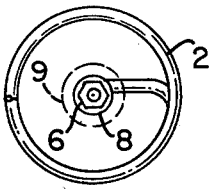
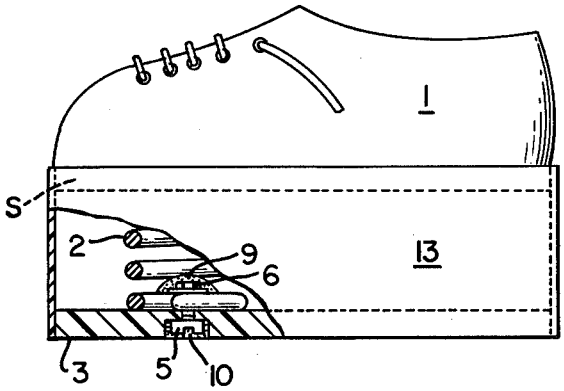
FIG. 3
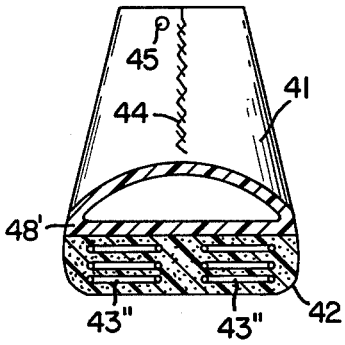
FIG. 5
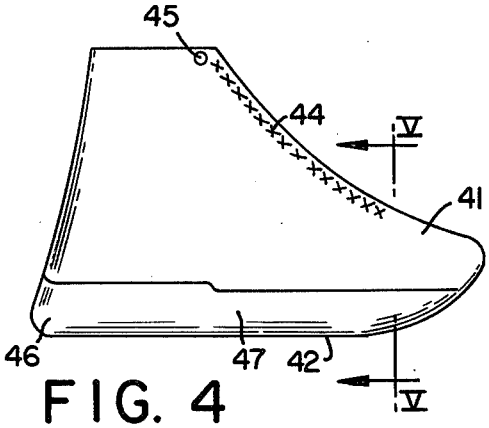
FIG. 4

HOPPING AND DANCING SHOES

This invention relates to improved hopping and dancing shoes which are more safe and less likely to injure the hopping shoe wearer.

BACKGROUND OF THE PRESENT INVENTION

In the past, hopping shoes have a sole member and a base member spaced from each other, and connected by the axial end portions of one or more coil springs. Such prior art shoes have been found to be hazardous and to twist ankles of the shoe user, upon each landing of the sole upon a hopping surface.

OBJECTS OF THE PRESENT INVENTION

It is an object of the present invention to provide an improved and more safe hopping and dancing shoe to eliminate potential injury to the user caused by accidental yawing of the sole member to the base member upon periodic landings.

It is another object of the invention to reduce slipping and sliding of the base member when it periodically lands upon a hopping surface.

DESCRIPTION OF THE DRAWINGS

FIG. 1 is a side view, partially in cross-section, of an improved hopping and dancing shoe;

FIG. 2 is a plan view of a coil spring through a line II—II in FIG. 1;

FIG. 3 is a side view, partially in cross-section, of an improved hopping shoe;

FIG. 4 is a side view of another hopping and dancing shoe.

FIG. 5 is a front view, partially in cross-section, of the hopping and dancing shoe along a line V—V in FIG. 4;

DETAILED DESCRIPTION OF THE PREFERRED EMBODIMENTS

Figure 6:
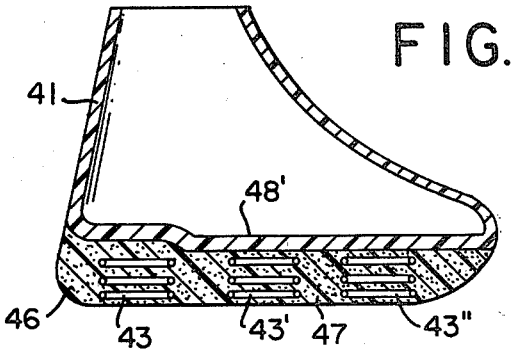
FIG. 6 is a side view, in cross-section, of the hopping and dancing shoe in FIG. 4.

Referring now to the drawings and particularly FIGS. 1 to 3, a hopping and dancing shoe 1 is illustrated including two coil springs 2, secured to a stable base member 3 of a suitable material such as rubber, plastics, leather, light metal etc. and a sole member S of the shoe body by means of bolts 5 and nuts 6 through washers 8.

The springs 2 have respectively centrally elongated portions at the both sides thereof and are connected with the sole S of shoe and the stable base 3 through their outer axial and centrally extending ends.

As shown in FIG. 1, the two outer coils of springs 2 are in contact with the sole member S and base member 3, even when the shoe is not placed upon the foot of the user, to provide frictional yawing resistance of the sole and base members. Such yawing frictional resistance is increased when the body weight of the user is placed upon the shoe.

Advantageously, the heads of bolts and nuts 5, 6 are respectively covered with the plastic adhesive agents such as a plastic cement 9, 10 to permanently connect the springs 2 with the shoe 1 and the stable base 3.

In this connection, it is advantageous to cover the heads of bolts 5 with the plastic cement 10 within recessed holes for the bolts 5, so as to eliminate slipping upon the ground or hopping surface to reduce injury to the shoe user.

It is also advantageous to sufficiently cover the heads of nuts 6 with the plastic cement 9 to prevent its corrosion and looseness caused by violent movement in its severe shock environment.

As shown, the springs 2 have a coil diameter approximately equal to width of the stable base 3 and should have sufficient strength to reduce lateral unsteadiness upon each landing.

Figure 9:
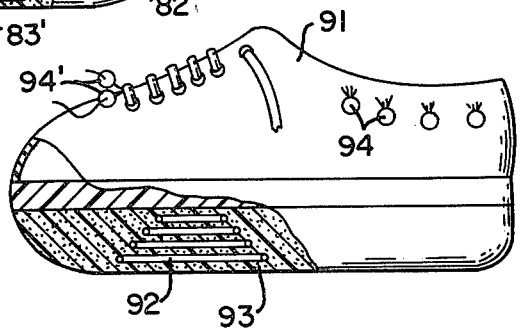
FIG. 9 is a side view, partially in cross-section, of another hopping and dancing shoe.

For use, the player places his foot into the shoe which may have a cushion mat 4 on its sole S and laces up the shoe firmly to hop and/or dance. A rhythm source H, such as castanets 94, 94′ as shown in FIG. 9 are attached to either the sole member, the shoe 1, or shoe laces to create a desired rhythm energized by the vibration or rhythmical movement of the player's foot.

As shown in FIG. 3, a rubber or plastic skirt 13 is attached to the base 3 and sole S of the shoe to cover the springs 2 for prevention of the intrusion of foreign substances, such as grass or a piece of wood between the coils of spring 2 which could cause the player to fall down. The skirt 13 also is useful to reinforce the balance of the shoe during the hopping and dancing.

Other hopping and dancing shoes are shown in FIG. 4 to FIG. 6 wherein a removable sole portion 42 including coil springs 43, 43′, 43″ are molded of heavy duty sponge rubber or plastics and are permanently combined with the shoe body by means of a chemical or thermal adhesion.

The molded material 46, 47, such as the heavy duty sponge rubber provide a cushion for the springs 43, 43′, 43″ to sustain the improved balance of the hopping and dancing shoes.

As seen in FIG. 5 and FIG. 6, the springs 43, 43′, 43″ are considerably smaller than the springs 2 in FIG. 1 and 3, and many of them are embedded in parallel relationship in the molded removable base portion 42 to improve the balance.

Figure 7:
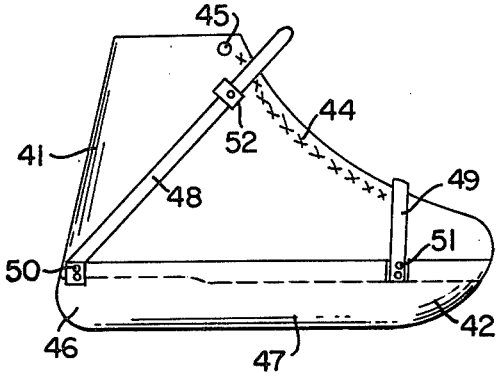
FIG. 7 is a side view of another hopping and dancing shoe.

So as to secure the removable base portion 42 in FIG. 7, straps 48 and 49 can be attached by rivets 50, 51 on suitable side position of the shoe body 41.

The player in this case puts firstly the shoe 41 upon his foot to fasten up fastener 44–45. He then attaches the molded separate portion 42 with the shoe 41, by means of the straps 48, 49′.

The sole removable portion 42 in this embodiment is very preferable to use because it is applicable to various sizes of the shoe 41.

Figure 8:
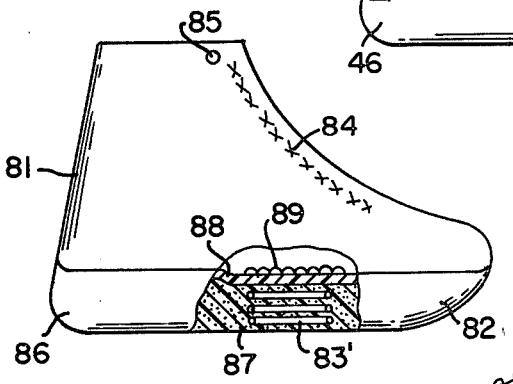
FIG. 8 is a side view, partially in cross-section, of another dancing and hopping shoe.

A hopping and dancing shoe 81 in FIG. 8 provides a member 89 on an internal mat 88 of the shoe 81 to excite and stimulate the foot and arch of the wearer. The excitement and stimulation of player's arch is amplified with cushioning of a spring 83 right under the stimulating member 89 embedded in heavy duty sponge material 87 of the removable portion 82 for improving the recovery of the player's physical fatigue.

Another hopping shoe is illustrated in FIG. 9 wherein large conical coil springs 93 are embedded in the removable portion 92 of the hopping and dancing shoe 91. Bells 94, 94′ can be attached to the sides of the shoe 91 or on its shoe lace. The large conical coil springs 93 can provide improved stabilization to provide lateral stabilization when the base 92 lands upon a hopping surface. It can also deaden metallic noises caused by the contact of the spring coils during the repeated hopping and dancing. The hopping and dancing shoe 91 is suitable to accompany music such as rock n' roll, a flamenco or disco by creating a desired rhythm with the bells 94, 94' during rhythmical movements of the shoe 91.

According to the invention, the player has less possibility of twisting his ankle during violent hopping and dancing while increasing his enjoyment of the selected rhythm created by the controlled movement of the player.

The player also recovers his physical fatigue while hopping and dancing because of the above mentioned stimulating member 89.

The present hopping and dancing shoes may be used by middle aged men for weight control exercise because rhythmic momentum exercise can expend very high energy per a unit time.

The molded removable portions described hereinbefore, may be improved by using two thin plates to the base 3 and the sole S of the shoe 1 shown in FIG. 1 respectively for the protection of the molded surfaces. In this case, the springs 43, 43' may first be connected with the two thin plates. The spaces around them in the mold can then be filled by the heavy duty sponge plastic material.

The removable sole portions may also be directly molded with the shoe in the mold with the above mentioned material along with the combination of the spring 2, base 3 and shoe 1 of FIG. 1.

While there has been described and pointed out the fundamental novel features of the invention as applied to preferred embodiments, it will be understood that various omissions and substitutions and changes in the form and details of the devices illustrated and its operation may be made by those skilled in the art, without departing from the spirit of the invention. It is the invention, therefore, to be limited only as indicated by the scope of the following claims.

We claim:

1. Hopping shoe comprising a sole member, a base member spaced from said sole member and a spring having outer coils in spaced parallel planes which are perpendicular to the axis of said coils and outer axial end portions, said spring having a diameter substantially equal to the width of said sole member and said base member, and connection means fixedly attaching said sole and said base to the axial outer ends of said spring, said connection means also positioning said sole and said base to come into contact with its juxtapositioned outer diameter coil of said spring wherein the static weight of the shoe wearer will unify, for rotational displacements, said sole and said base by friction to its justapositioned outer full diameter coil of said spring.

2. Hopping shoe according to claim 1 wherein said sole and said base have cavities therein and said connection means includes a bolt and a nut which reside in the cavities in said sole and said base so that no portion of said bolt or said nut protrude to touch the wearer of the shoe or the supporting surface which can come into contact with said sole.

3. A hopping shoe according to claim 1 including a castanet, or the like, attached to said shoe.

4. Hopping shoe according to claim 1 wherein both outer coils of said spring are substantially of the same diameter.

* * * * *